US008059055B2

(12) United States Patent
Tsai et al.

(10) Patent No.: US 8,059,055 B2
(45) Date of Patent: Nov. 15, 2011

(54) ULTRA-WIDEBAND ANTENNA

(75) Inventors: Tiao-Hsing Tsai, Yungho (TW); Chih-Wei Liao, Yilan Shien (TW); Chao-Hsu Wu, Tao Yuan Shien (TW); Chi-Yin Fang, Pingtung (TW)

(73) Assignee: Quanta Computer Inc. (TW)

( * ) Notice: Subject to any disclaimer, the term of this patent is extended or adjusted under 35 U.S.C. 154(b) by 529 days.

(21) Appl. No.: 12/169,346

(22) Filed: Jul. 8, 2008

(65) Prior Publication Data

US 2009/0237307 A1 Sep. 24, 2009

(30) Foreign Application Priority Data

Mar. 19, 2008 (TW) ..... 97109618 A

(51) Int. Cl.
*H01Q 1/38* (2006.01)

(52) U.S. Cl. ..... 343/826; 343/702

(58) Field of Classification Search ..... 343/702, 343/844, 828, 829, 846, 825, 826, 843
See application file for complete search history.

(56) References Cited

U.S. PATENT DOCUMENTS 4,625,212 A * 11/1986 Oda et al. ..... 343/702
7,170,456 B2 1/2007 Kwak et al.
7,268,741 B2 9/2007 Sarabandi et al.

OTHER PUBLICATIONS

Search Report—Taiwanese Application No. 097109618, dated Apr. 28, 2011 (1 page).

* cited by examiner

*Primary Examiner* — Michael C Wimer
(74) *Attorney, Agent, or Firm* — Sunstein Kann Murphy & Timbers LLP

(57) ABSTRACT

An antenna includes first and second radiating elements and a conductive arm. The second radiating element has opposite feeding and grounding end portions, each of which is coupled to a respective one of feeding and grounding end portions of the first radiating element. The conductive arm is coupled to the feeding end portion of the second radiating element.

16 Claims, 11 Drawing Sheets

H Plane( X-Y plane, $\theta$=90)

Peak = 1.09 dBi, Avg. = -1.26 dBi.

E1 Plane( X-Y plane, $\Phi$=0)

Peak = 4.23 dBi, Avg. = 1.31 dBi.

E2 Plane( X-Y plane, $\Phi$=90)

Peak = 1.39 dBi, Avg. = -1.53 dBi.

H Plane( X-Y plane, $\theta$=90)

Peak = 2.2 dBi, Avg. = -1.9 dBi.

E1 Plane( X-Y plane, $\Phi$=0)

Peak = 2.25 dBi, Avg. = 0.53 dBi.

E2 Plane( X-Y plane, $\Phi$=90)

Peak = 2.25 dBi, Avg. = -2.26 dBi.

H Plane( X-Y plane, $\theta$ =90)

Peak = 0.95 dBi, Avg. = -1.4 dBi.

E1 Plane( X-Y plane, Φ=0)

Peak = 3.47 dBi, Avg. = 0.15 dBi.

E2 Plane( X-Y plane, Φ=90)

Peak = 0.37 dBi, Avg. = -2.49 dBi.

H Plane( X-Y plane, $\theta$ =90)

Peak = 1.54 dBi, Avg. = -2.92 dBi.

E1 Plane( X-Y plane, $\Phi$=0)

Peak = 5.68 dBi, Avg. = 0.32 dBi.

E2 Plane( X-Y plane, $\Phi$=90)

Peak = 2.74 dBi, Avg. = -3.32 dBi.

H Plane( X-Y plane, $\theta$=90)

Peak = 1.29 dBi, Avg. = -4.02 dBi.

E1 Plane( X-Y plane, $\Phi$=0)

Peak = 3.79 dBi, Avg. = -1.07 dBi.

E2 Plane( X-Y plane, $\Phi$=90)

Peak = 1.87 dBi, Avg. = -5.47 dBi.

ULTRA-WIDEBAND ANTENNA

CROSS-REFERENCE TO RELATED APPLICATION

This application claims priority of Taiwanese application no. 097109618, filed on Mar. 19, 2008.

BACKGROUND OF THE INVENTION

1. Field of the Invention

This invention relates to an antenna, more particularly to an ultra-wideband antenna.

2. Description of the Related Art

A conventional antenna, such as a monopole antenna or a planar inverted-F antenna (PIFA), which is applicable to a wireless personal area network (WPAN) and which is operable in a Bluetooth frequency range from 2402 MHz to 2480 MHz and an ultra-wideband (UWB) Band I frequency range from 3168 MHz to 4752 MHz, is well known in the art.

The aforementioned conventional antenna is disadvantageous in that it deviates easily from the Bluetooth and the UWB Band I frequency ranges even with a small inaccuracy in the positioning thereof on a circuit board, which may occur during installation thereof on the circuit board.

SUMMARY OF THE INVENTION

Therefore, the object of the present invention is to provide an antenna that can overcome the aforesaid drawback of the prior art.

According to the present invention, an antenna comprises first and second radiating elements and a conductive arm. The first radiating element has opposite feeding and grounding end portions. The second radiating element has opposite feeding and grounding end portions, each of which is coupled to a respective one of the feeding and grounding end portions of the first radiating element. The conductive arm is coupled to the feeding end portion of the second radiating element.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
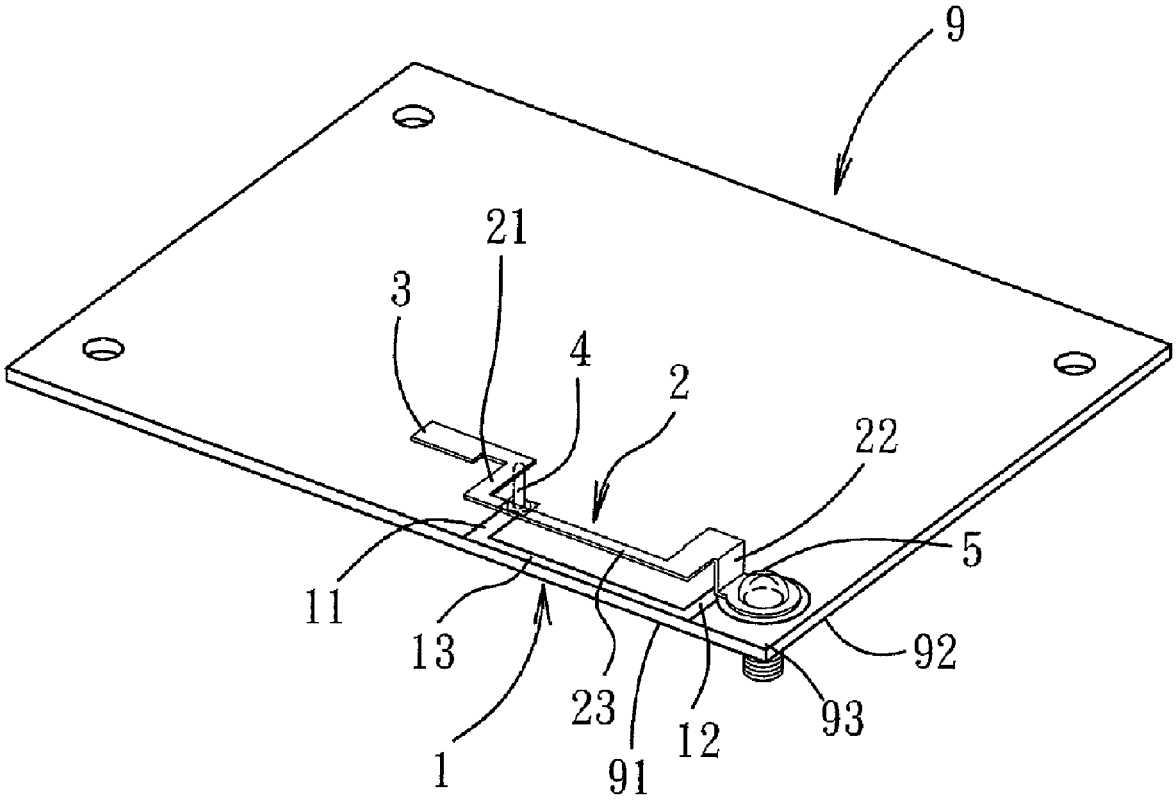
FIG. 1 is a perspective view of the preferred embodiment of an antenna according to this invention.

Referring to FIG. 1, the preferred embodiment of an antenna according to this invention is shown to include first and second radiating elements 1, 2 and a conductive arm 3.

The antenna of this invention is an ultra-wideband (UWB) antenna, has a relatively small physical size, is applicable to a wireless personal area network (WPAN) is installed in an electronic device (not shown), such as an ultra-mobile personal computer (UMPC), and is operable in a Bluetooth frequency range from 2402 MHz to 2480 MHz and a UWB Band I frequency range from 3168 MHz to 4752 MHz.

The antenna further includes a dielectric substrate 9 on which a circuit (not shown) of the electronic device is mounted. In this embodiment, the dielectric substrate 9 is generally rectangular in shape, has a pair of edges 91, 92, and a corner 93 defined by the edges 91, 92 thereof.

The first radiating element 1 is formed, such as by printing, on the dielectric substrate 9, is generally U-shaped, and has opposite feeding and grounding end portions 11, 12 that are parallel, and an intermediate portion 13 that interconnects the feeding and grounding end portions 11, 12 thereof. The feeding end portion 11 of the first radiating element 1 has a distal end that is distal from the intermediate portion 13 of the first radiating element 1 and that is connected to a transceiver (not shown) of the circuit of the electronic device. The grounding end portion 12 of the first radiating element 1 has a distal end that is distal from the intermediate portion 13 of the first radiating element 1 and that is connected to an electrical ground (not shown) of the circuit of the electronic device. In this embodiment, the first radiating element 1 is made from a copper foil. Moreover, in this embodiment, the first radiating element 1 is disposed at the edge 91 of the dielectric substrate 9, thereby preventing electromagnetic interference from the circuit of the electronic device. Further, in this embodiment, the intermediate portion 13 of the first radiating element 1 is flush with the edge 91 of the dielectric substrate 9.

It is noted that, since the first radiating element 1 is formed on the dielectric substrate 9, the antenna of this invention costs less to manufacture and has a stable structure.

Figure 2:
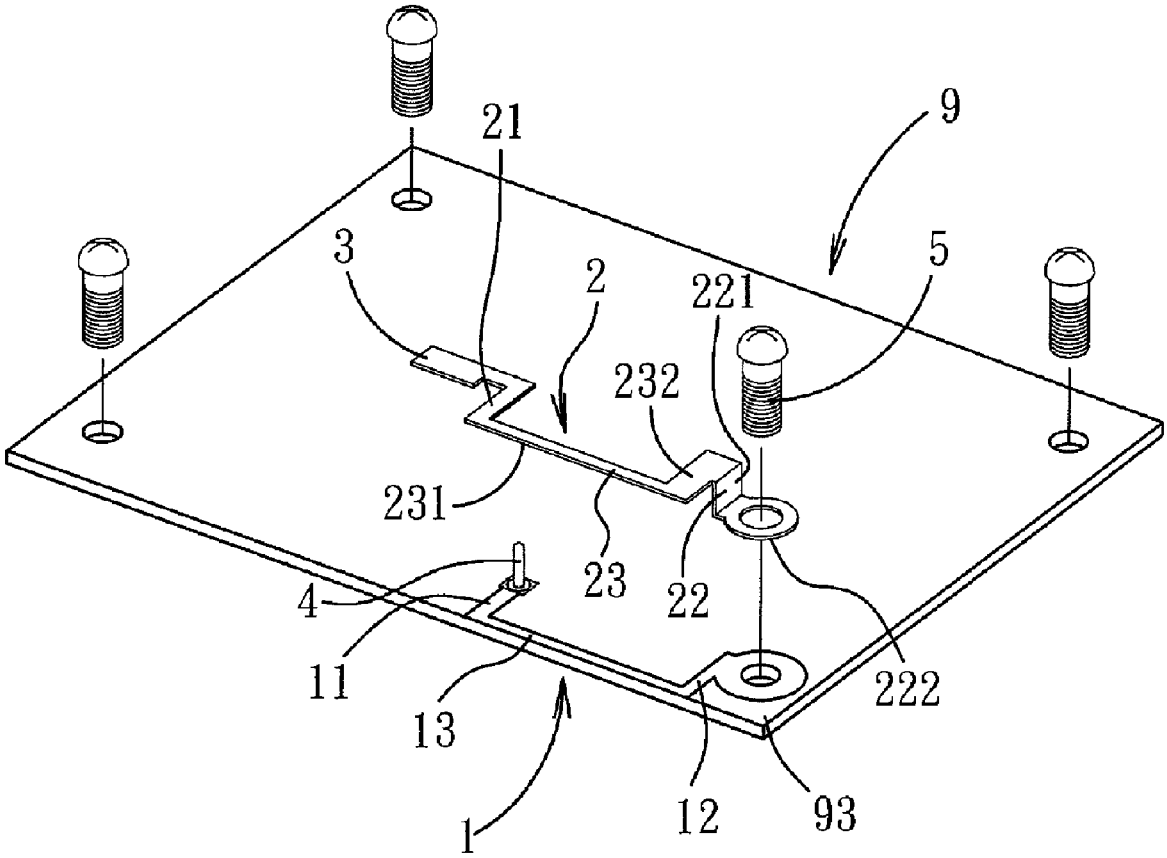
FIG. 2 is an exploded perspective view of the preferred embodiment.

The second radiating element 2 has opposite feeding and grounding end portions 21, 22, and an intermediate portion 23 that interconnects the feeding and grounding end portions 21, 22 thereof. In this embodiment, with further reference to FIG. 2, the intermediate portion 23 of the second radiating element 2 is spaced apart from the first radiating element 1 and the dielectric substrate 9, is generally L-shaped, and includes first and second segments 231, 232. The first segment 231 of the intermediate portion 23 of the second radiating element 2 is parallel to and overlaps the intermediate portion 13 of the first radiating element 1, and has a distal end that is distal from the second segment 232 of the intermediate portion 23 of the second radiating element 2. The second segment 232 of the intermediate portion 23 of the second radiating element 2 has a distal end that is distal from the first segment 231 of the intermediate portion 23 of the second radiating element 2. The feeding end portion 21 of the second radiating element 2 is spaced apart from the first radiating element 1 and the dielectric substrate 9, extends transversely from the first segment 231 of the intermediate portion 23 of the second radiating element 2, is parallel to and overlaps the feeding end portion 11 of the first radiating element 1, and has a first end that is connected to the distal end of the first segment 231 of the intermediate portion 23 of the second radiating element 2, and a second end opposite to the first end thereof. The grounding end portion 22 of the second radiating element 2 is generally L-shaped, and has first and second segments 221, 222. The first segment 221 of the grounding end portion 22 of the second radiating element 2 extends transversely from the second segment 232 of the intermediate portion 23 of the second radiating element 2, and has a first end connected to the distal end of the second segment 232 of the intermediate portion 23 of the second radiating element 2, and a second end opposite to the first end thereof. The second segment 222 of the grounding end portion 22 of the second radiating element 2 is mounted removably to the dielectric substrate 9 to thereby couple the second segment 222 of the grounding end portion 22 of the second radiating element 2 to the distal end of the grounding end portion 12 of the first radiating element 1.

The antenna further includes a screw 5 for mounting removably the second segment 222 of the grounding end portion 22 of the second radiating element 2 to the dielectric substrate 9. In particular, each of the corner 93 of the dielectric substrate 9, the distal end of the grounding end portion 12 of the first radiating element 1, and the second segment 222 of the grounding end portion 22 of the second radiating element 2 is formed with a hole therethrough. The screw 5 extends through the hole in each of the second segment 222 of the grounding end portion 22 of the second radiating element 2, the distal end of the grounding end portion 12 of the first radiating element 1, and the corner 93 of the dielectric substrate 9, and threadedly engages the dielectric substrate 9.

The conductive arm 3 is spaced apart from the first radiating element 1 and the dielectric substrate 9, extends transversely from the feeding end portion 21 of the second radiating element 2 in a direction away from the second segment 232 of the intermediate portion 23 of the second radiating element 2, and has an end connected to the second end of the feeding end portion 21 of the second radiating element 2.

In this embodiment, each of the second radiating element 2 and the conductive arm 3 is a metallic strip. Moreover, in this embodiment, the feeding end portion 21 and the intermediate portion 23 of the second radiating element 2 and the conductive arm 3 are coplanar.

The antenna further includes a conductive piece 4 that interconnects the distal end of the feeding end portion 11 of the first radiating element 1 and the second end of the feeding end portion 21 of the second radiating element 2. In this embodiment, the conductive piece 4 is a pin. In an alternative embodiment, the conductive piece 4 is a resilient conductive piece.

It is noted that aside from supporting the second radiating element 2 on the dielectric substrate 9, the conductive piece 4 serves as a signal feed.

Figure 3:
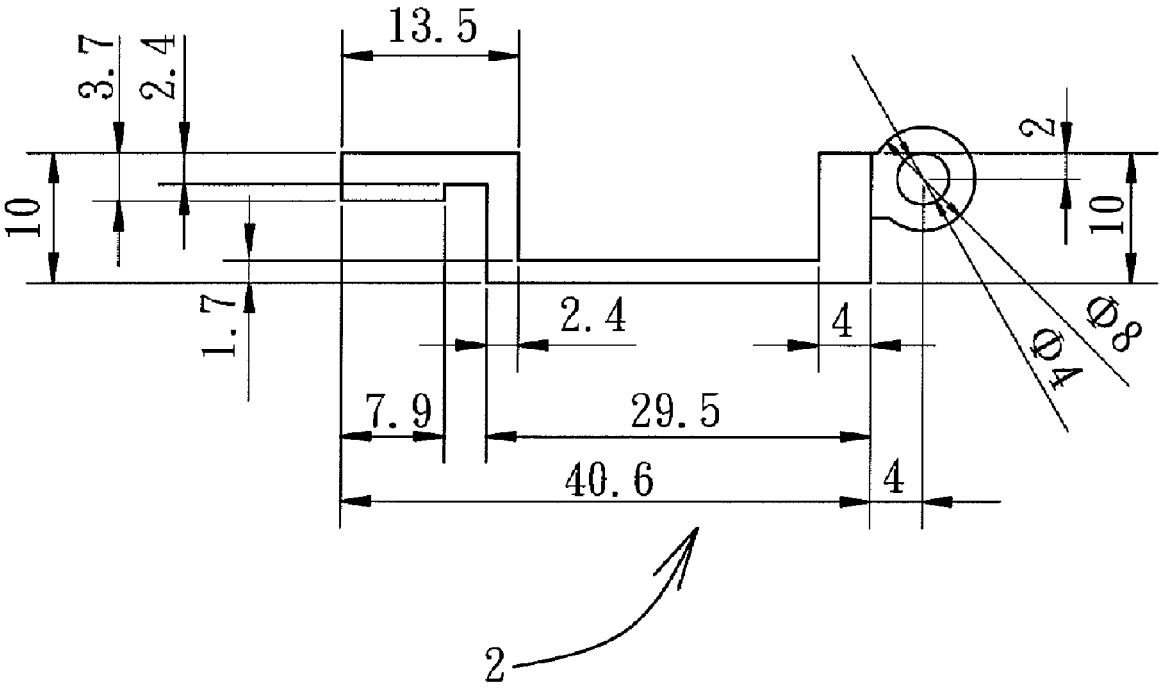
FIG. 3 to 5 are schematic views illustrating dimensions of the preferred embodiment.
Figure 4:
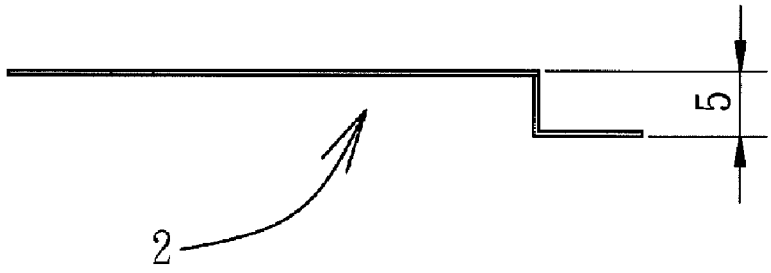
Figure 5:
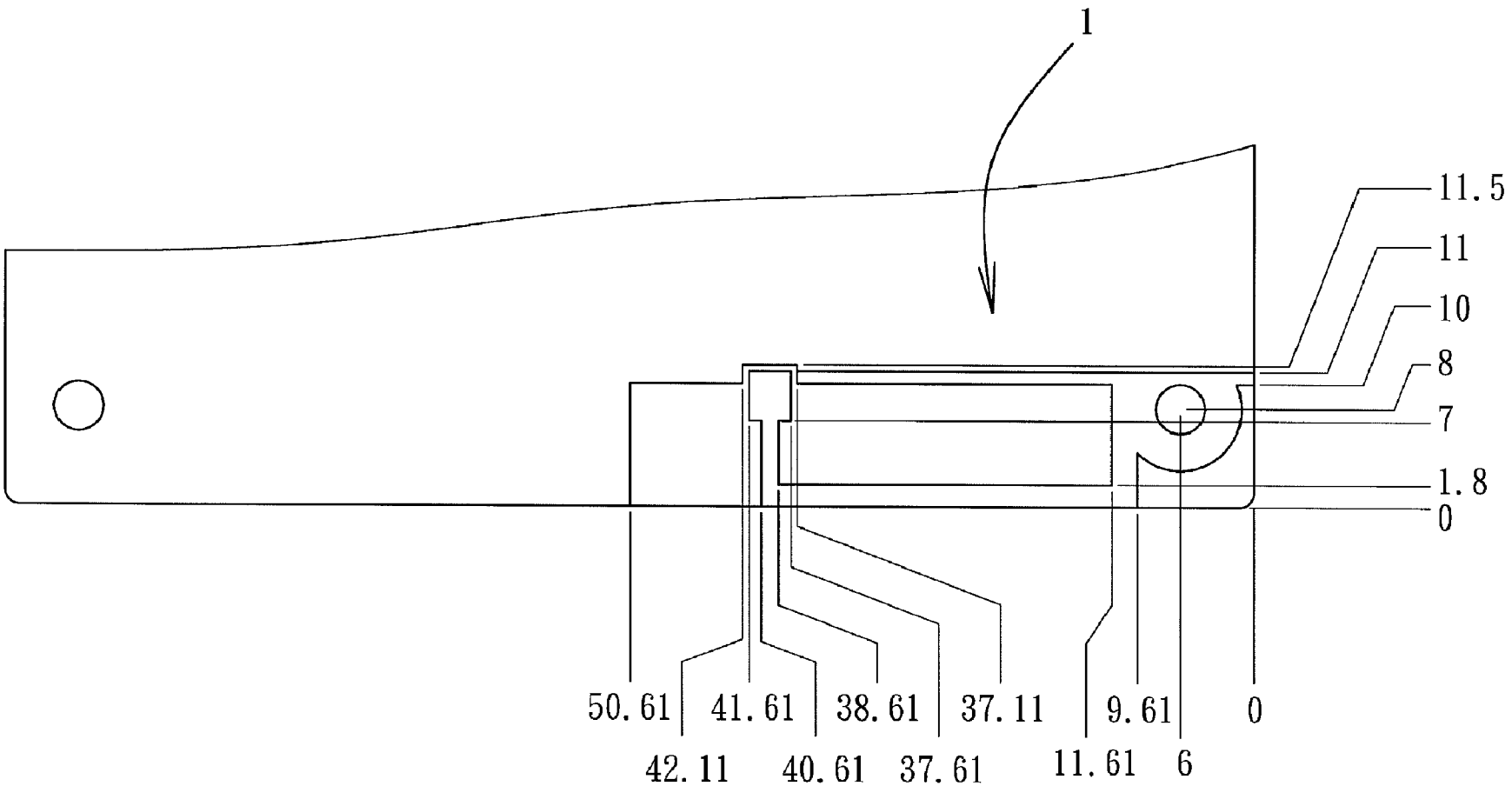

As illustrated in FIG. 3 to 5, the antenna of this invention indeed has a relatively small physical size.

It is noted that the length of each of the first and second radiating elements 1, 2 may be adjusted so as to match an impedance of the transceiver of the circuit of the electronic device.

In this embodiment, the second radiating element 2 and the conductive arm 3 resonate in a first frequency range that cover the Bluetooth frequency range. Moreover, the second and first radiating elements 1, 2 resonate in second and third frequency ranges, respectively, that are partially overlapped and that cover the UWB Band I frequency range.

Figure 6:
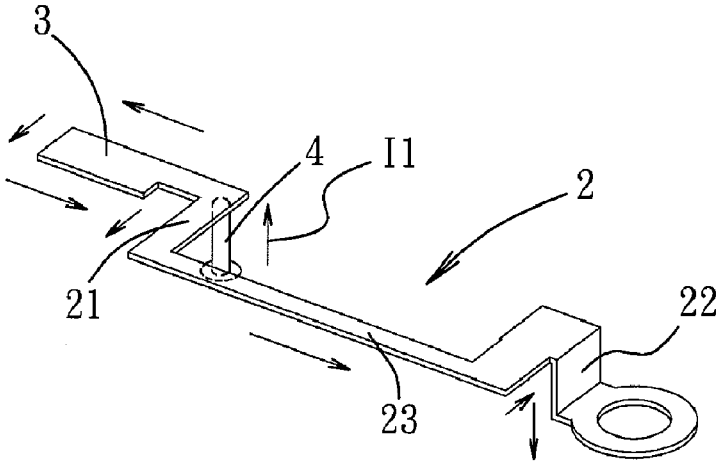
FIG. 6 is a perspective view illustrating a current path when the preferred embodiment is operated in a first frequency range.

FIG. 6 illustrates a current path (I1), which flows through the conductive piece 4, the conductive arm 3, and the feeding end portion 21, the intermediate portion 23, and the grounding end portion 22 of the second radiating element 2, when the antenna of this invention is operated in the first frequency range.

Figure 7:
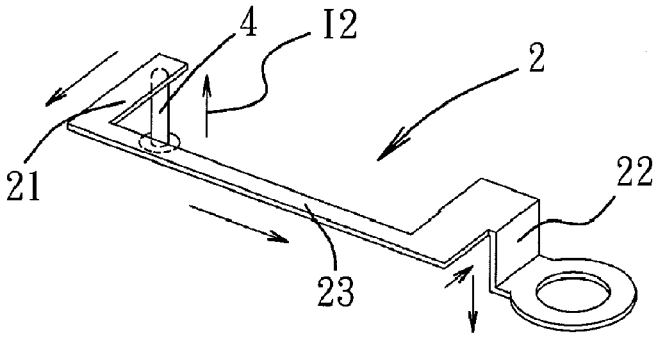
FIG. 7 is a perspective view illustrating a current path when the preferred embodiment is operated in a second frequency range.

FIG. 7 illustrates a current path (I2), which flows through the conductive piece 4, and the feeding end portion 21, the intermediate portion 23, and the grounding end portion 22 of the second radiating element 2, when the antenna of this invention is operated in the second frequency range.

Figure 8:
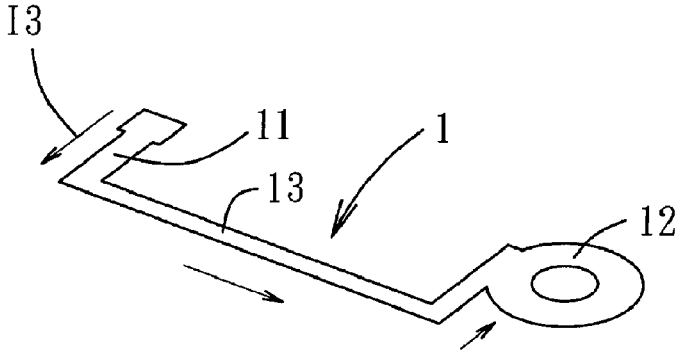
FIG. 8 is a perspective view illustrating a current path when the preferred embodiment is operated in a third frequency range.

FIG. 8 illustrates a current path (I3), which flows through the feeding end portion 11, the intermediate portion 13, and grounding end portion 12 of the first radiating element 1, when the antenna of this invention is operated in the third frequency range.

Figure 9:
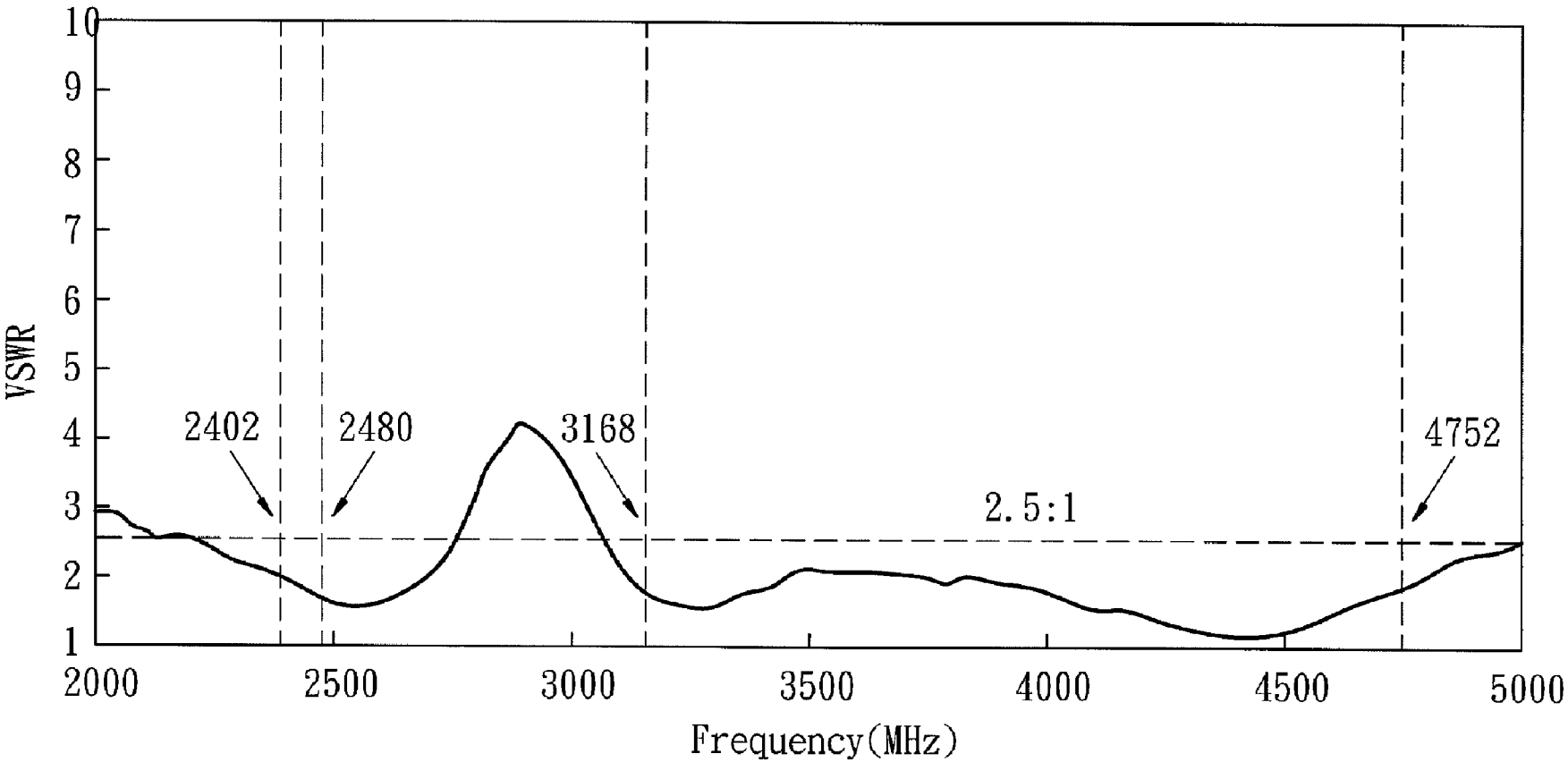
FIG. 9 is a plot illustrating a voltage standing wave ratio (VSWR) of the preferred embodiment.
Figure 10:
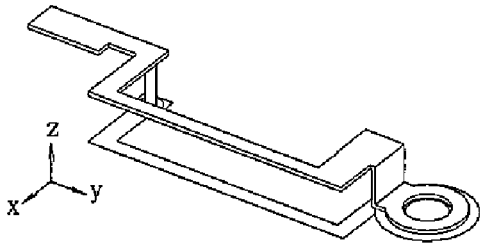
FIG. 10 shows plots of radiation patterns of the preferred embodiment respectively on the x-y, x-z, and y-z planes when operated at 2440 MHz.
Figure 10:
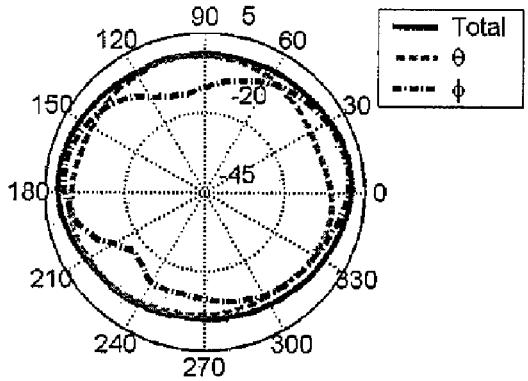
Figure 10:
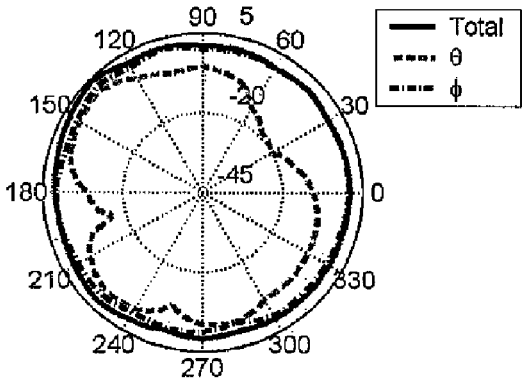
Figure 10:
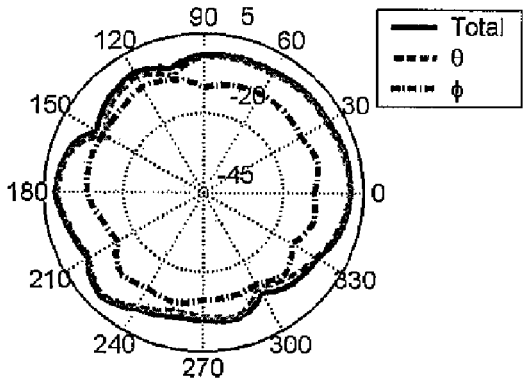
Figure 11:
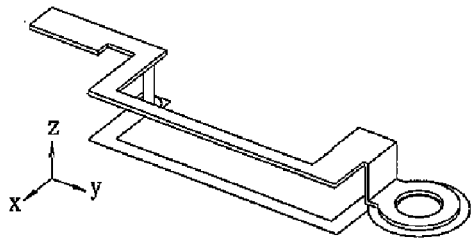
FIG. 11 shows plots of radiation patterns of the preferred embodiment respectively on the x-y, x-z, and y-z planes when operated at 3168 MHz.
Figure 11:
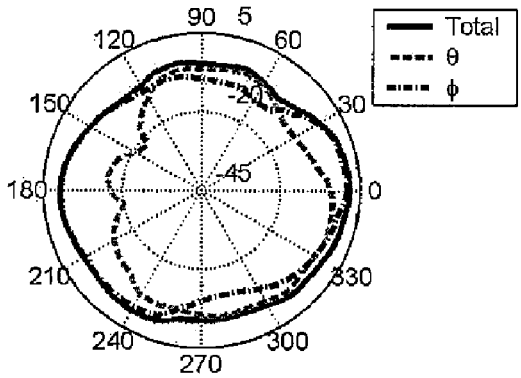
Figure 11:
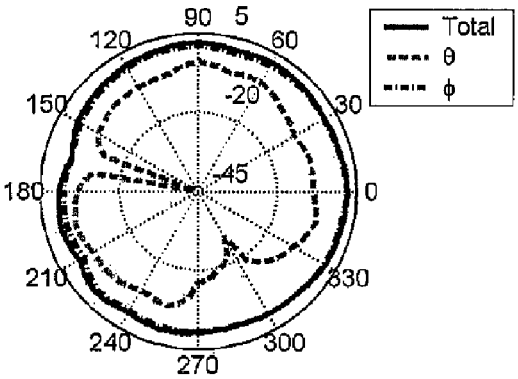
Figure 11:
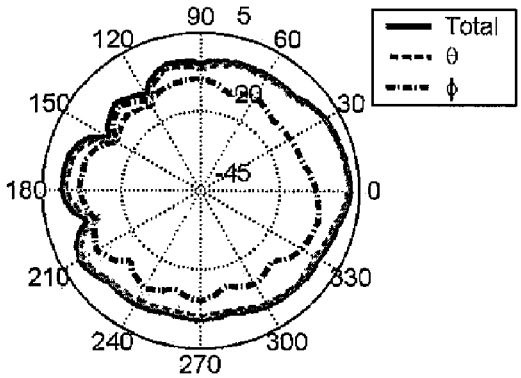
Figure 12:
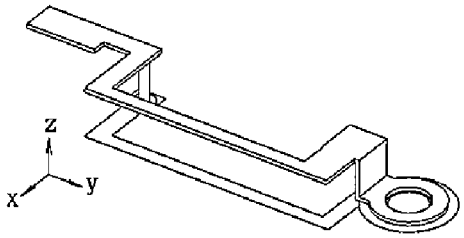
FIG. 12 shows plots of radiation patterns of the preferred embodiment respectively on the x-y, x-z, and y-z planes when operated at 3696 MHz.
Figure 12:
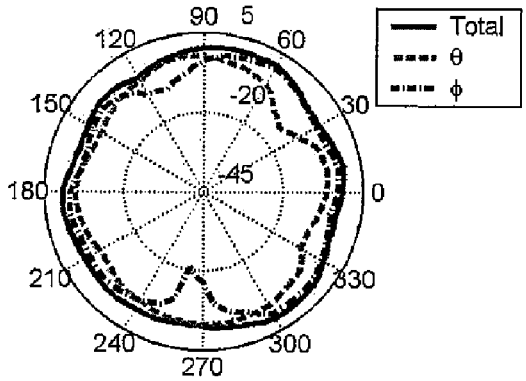
Figure 12:
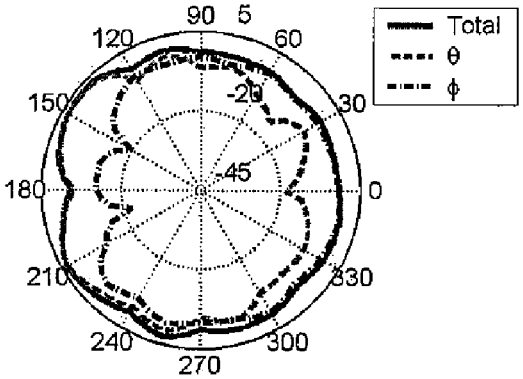
Figure 12:
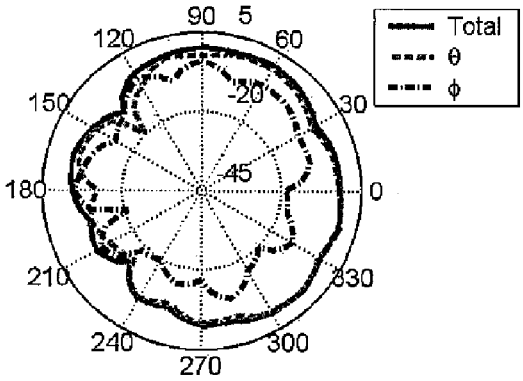
Figure 13:
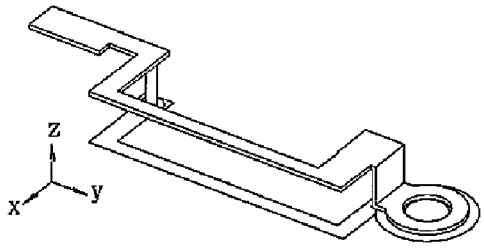
FIG. 13 shows plots of radiation patterns of the preferred embodiment respectively on the x-y, x-z, and y-z planes when operated at 4224 MHz.
Figure 13:
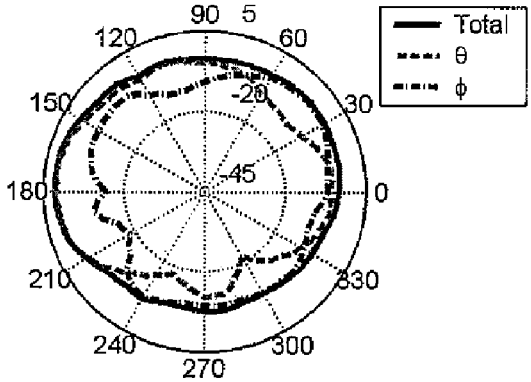
Figure 13:
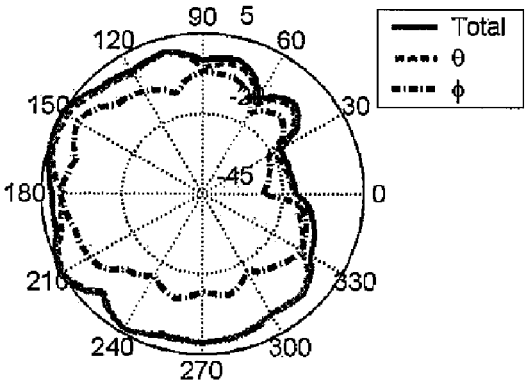
Figure 13:
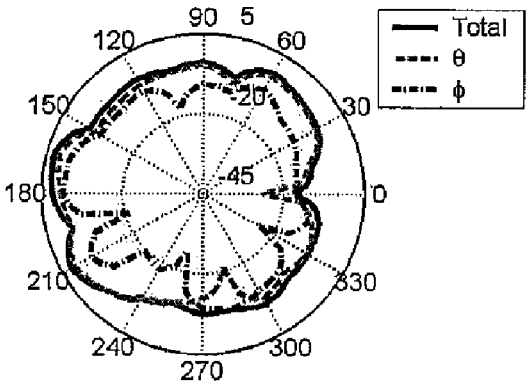
Figure 14:
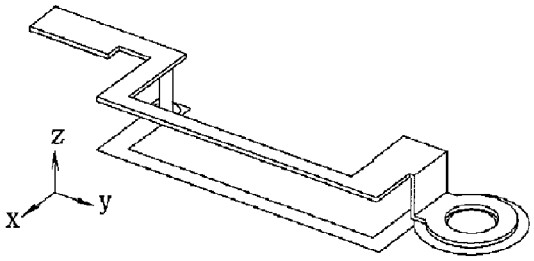
FIG. 14 shows plots of radiation patterns of the preferred embodiment respectively on the x-y, x-z, and y-z planes when operated at 4752 MHz.
Figure 14:
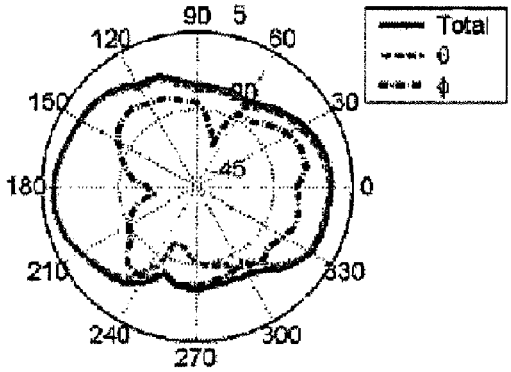
Figure 14:
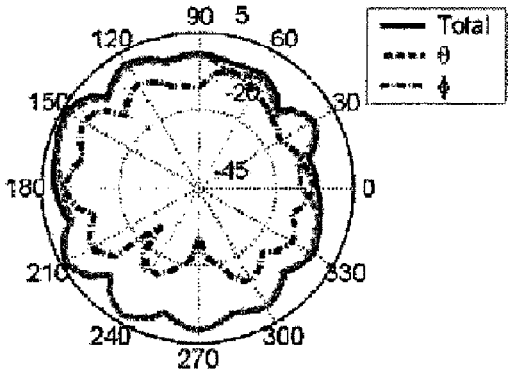
Figure 14:
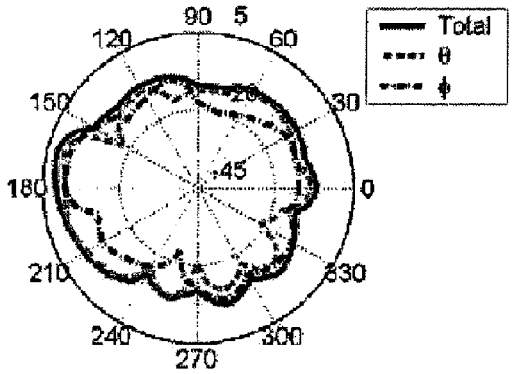

Experimental results, as illustrated in FIG. 9, show that the antenna of this invention achieves a voltage standing wave ratio (VSWR) of less than 2.5 when operated in each the Bluetooth frequency range and the UWB Band I frequency range. Moreover, as shown in Table I below, the antenna of this invention achieves a maximum total radiation power (TRP) of 0.46 dBm and a maximum efficiency of 90.01%. Further, as illustrated in FIG. 10 to 14, the antenna of this invention has substantially omnidirectional radiation patterns when operated at 2440 MHz, 3168 MHz, 3696 MHz, 4224 MHz, and 4752 MHz, respectively.

TABLE I

| Frequency (MHz) | TRP (dBm) | Efficiency (%) |
|---|---|---|
| 2402 | −1.29 | 74.26 |
| 2440 | −0.61 | 86.88 |
| 2480 | −0.46 | 90.01 |
| 3168 | −1.70 | 67.68 |
| 3432 | −1.06 | 78.40 |
| 3696 | −1.33 | 73.61 |
| 3960 | −1.07 | 78.25 |
| 4224 | −1.56 | 69.88 |
| 4488 | −2.66 | 54.19 |
| 4752 | −3.61 | 43.58 |

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. An antenna comprising:

a first radiating element having opposite feeding and grounding end portions, said feeding end portion configured to connect to a transceiver;

a second radiating element having opposite feeding and grounding end portions, each of which is coupled to a respective one of said feeding and grounding end portions of said first radiating element; and a conductive arm coupled to said feeding end portion of said second radiating element, wherein:

said second radiating element and said conductive arm are configured to resonate in a first frequency range, and a first current path flows through said conductive arm and said second radiating element when the antenna operates in the first frequency range;

said second radiating element is configured to resonate in a second frequency range, and a second current path flows through said second radiating element and does not flow through said conductive arm when the antenna operates in the second frequency range; and said first radiating element is configured to resonate in a third frequency range, and a third current path flows through said first radiating element when the antenna operates in the third frequency range.

2. The antenna as claimed in claim 1, further comprising a dielectric substrate on which said first radiating element is formed.

3. The antenna as claimed in claim 2, wherein said first radiating element is formed on said dielectric substrate by printing.

4. The antenna as claimed in claim 2, wherein said dielectric substrate has an edge at which said first radiating element is disposed.

5. The antenna as claimed in claim 2, wherein said second radiating element further has an intermediate portion that interconnects said feeding and grounding end portions thereof, said feeding end portion and said intermediate portion of said second radiating element and said conductive arm being spaced apart from said first radiating element and said dielectric substrate, said grounding end portion of said second radiating element being mounted to said dielectric substrate, thereby coupling said grounding end portion of said second radiating element to said grounding end portion of said first radiating element.

6. The antenna as claimed in claim 5, wherein said feeding end portion of said second radiating element is parallel to and overlaps said feeding end portion of said first radiating element.

7. The antenna as claimed in claim 5, wherein said first radiating element further has an intermediate portion that interconnects said feeding and grounding end portions thereof, said intermediate portion of said second radiating element including a segment that is parallel to and that overlaps said intermediate portion of said first radiating element.

8. The antenna as claimed in claim 5, wherein said feeding end portion and said intermediate portion of said second radiating element and said conductive arm are coplanar.

9. The antenna as claimed in claim 5, wherein said grounding end portion of said second radiating element is mounted removably to said dielectric substrate, thereby coupling removably said grounding end portion of said second radiating element to said grounding end portion of said first radiating element.

10. The antenna as claimed in claim 9, further comprising a screw extending through said grounding end portions of said first and second radiating elements and said dielectric substrate and threadedly engaging said dielectric substrate.

11. The antenna as claimed in claim 1, wherein at least one of said second radiating element and said conductive arm is a metallic strip.

12. The antenna as claimed in claim 1, further comprising a conductive piece interconnecting said feeding end portions of said first and second radiating elements.

13. The antenna as claimed in claim 12, wherein said conductive piece is a pin.

14. The antenna as claimed in claim 1, wherein said first radiating element is generally U-shaped.

15. The antenna as claimed in claim 1, wherein the second frequency range is higher than the first frequency range, and the third frequency range is higher than the first frequency range and partially overlaps the second frequency range.

16. The antenna as claimed in claim 15, wherein the first frequency range covers frequencies from 2402 MHz to 2480 MHz, and the second and third frequency ranges cover frequencies from 3168 MHz to 4752 MHz.

* * * * *